US010389043B2

(12) United States Patent
Riku

(10) Patent No.: US 10,389,043 B2
(45) Date of Patent: Aug. 20, 2019

(54) ELECTRICAL CONNECTOR WITH A SEPARATE RELEASING OPERATION PORTION ATTACHED TO THE LOCK ARM MAIN BODY

(71) Applicant: Tyco Electronics Japan G.K., Kanagawa (JP)

(72) Inventor: Kazuya Riku, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/952,823

(22) Filed: Apr. 13, 2018

(65) Prior Publication Data

US 2018/0301824 A1 Oct. 18, 2018

(30) Foreign Application Priority Data

Apr. 14, 2017 (JP) ..... 2017-080812

(51) Int. Cl.

| | |
|---|---|
| ***H01R 4/48*** | (2006.01) |
| ***H01R 13/627*** | (2006.01) |
| ***H01R 13/50*** | (2006.01) |
| ***H01R 43/00*** | (2006.01) |
| ***H01R 13/633*** | (2006.01) |
| *H01R 13/11* | (2006.01) |
| *H01R 13/504* | (2006.01) |

(52) U.S. Cl.

CPC ..... *H01R 4/48* (2013.01); *H01R 13/50* (2013.01); *H01R 13/6271* (2013.01); *H01R 13/6273* (2013.01); *H01R 13/633* (2013.01); *H01R 43/00* (2013.01); *H01R 4/4845* (2013.01); *H01R 13/112* (2013.01); *H01R 13/504* (2013.01)

(58) Field of Classification Search

CPC ..... H01R 4/48; H01R 13/50; H01R 13/6273; H01R 43/00; H01R 13/112

USPC ..... 439/367, 345, 352–354, 358

See application file for complete search history.

(56) References Cited

U.S. PATENT DOCUMENTS

| | | | | |
|---|---|---|---|---|
| 5,529,507 | A * | 6/1996 | Felix | H01R 13/641 439/188 |
| 5,860,837 | A | 1/1999 | Böck et al. | |
| 6,746,265 | B2 | 6/2004 | Shirai et al. | |
| 7,381,087 | B2 * | 6/2008 | Alvarez | H01R 13/518 439/540.1 |
| 8,873,921 | B2 * | 10/2014 | Lee | G02B 6/3849 385/134 |
| 9,069,149 | B2 * | 6/2015 | Yu | G02B 6/3898 |
| 2008/0020628 | A1 | 1/2008 | Kikuchi | |

(Continued)

FOREIGN PATENT DOCUMENTS

| | | |
|---|---|---|
| JP | 2002-110295 A | 4/2002 |
| JP | 2015-523700 A | 8/2015 |

OTHER PUBLICATIONS

Abstract of JP2015523700, dated Aug. 13, 2015, 2 pages.

(Continued)

*Primary Examiner* — Travis S Chambers
(74) *Attorney, Agent, or Firm* — Barley Snyder

(57) ABSTRACT

An electrical connector comprises a contact, a housing retaining the contact, and a lock arm configured to catch a mating connector. The lock arm has an arm main body integrally formed with the housing and a releasing operation portion formed separately from the housing and attached to the arm main body.

12 Claims, 6 Drawing Sheets

(56) References Cited

U.S. PATENT DOCUMENTS

| | | | | |
|---|---|---|---|---|
| 2014/0270675 | A1* | 9/2014 | Yu | G02B 6/3898 385/135 |
| 2015/0056832 | A1 | 2/2015 | Fransen et al. | |
| 2015/0236433 | A1* | 8/2015 | Kusuhara | H01R 4/2466 439/395 |

OTHER PUBLICATIONS

Abstract of JP2002110295, dated Apr. 12, 2002, 2 pages.
Extended European Search Report, European Patent Application No. 18167301.3, dated Aug. 13, 2018, 7 pages.

* cited by examiner

ELECTRICAL CONNECTOR WITH A SEPARATE RELEASING OPERATION PORTION ATTACHED TO THE LOCK ARM MAIN BODY

CROSS-REFERENCE TO RELATED APPLICATION

This application claims the benefit of the filing date under 35 U.S.C. § 119(a)-(d) of Japanese Patent Application No. 2017-080812, filed on Apr. 14, 2017.

FIELD OF THE INVENTION

The present invention relates to an electrical connector and, more particularly, to a terminal block electrical connector.

BACKGROUND

Electrical connectors connecting terminals together are widely used for power supply, grounding, control, or the like, and are used in a variety of devices and equipment, including industrial machinery and vehicles.

Such an electrical connector, as disclosed in Japanese Patent Application No. 2015-523700A, has a lock arm for catching a mating connector. The lock arm secures the connector and the mating connector in a mating position. The lock arm of JP 2015-523700A is formed integrally with a housing of the electrical connector. At an end of the lock arm, an operation portion for unlocking protrudes in a direction of height from a main body of the lock arm.

The shape of the housing of the electrical connector depends on the shape and/or position of a member housed in the housing. The configuration and/or direction of movement of a mold part used in injection molding the housing is dictated by the shape of the housing. Therefore, the dimensions and/or shape of the lock arm formed integrally with the housing may be limited by the configuration and/or direction of movement of the mold part. In particular, the height of the operation portion for unlocking is commonly limited by the mold part.

SUMMARY

An electrical connector comprises a contact, a housing retaining the contact, and a lock arm configured to catch a mating connector. The lock arm has an arm main body integrally formed with the housing and a releasing operation portion formed separately from the housing and attached to the arm main body.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
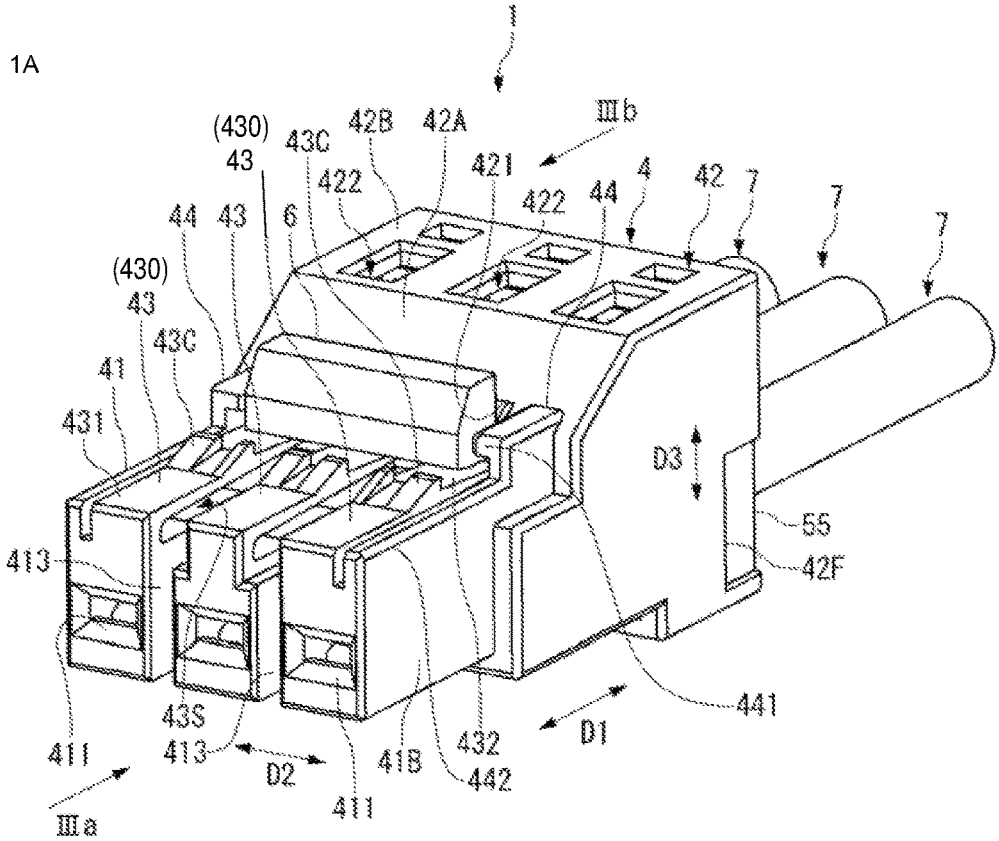
FIG. 1A is a perspective view of an electrical connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
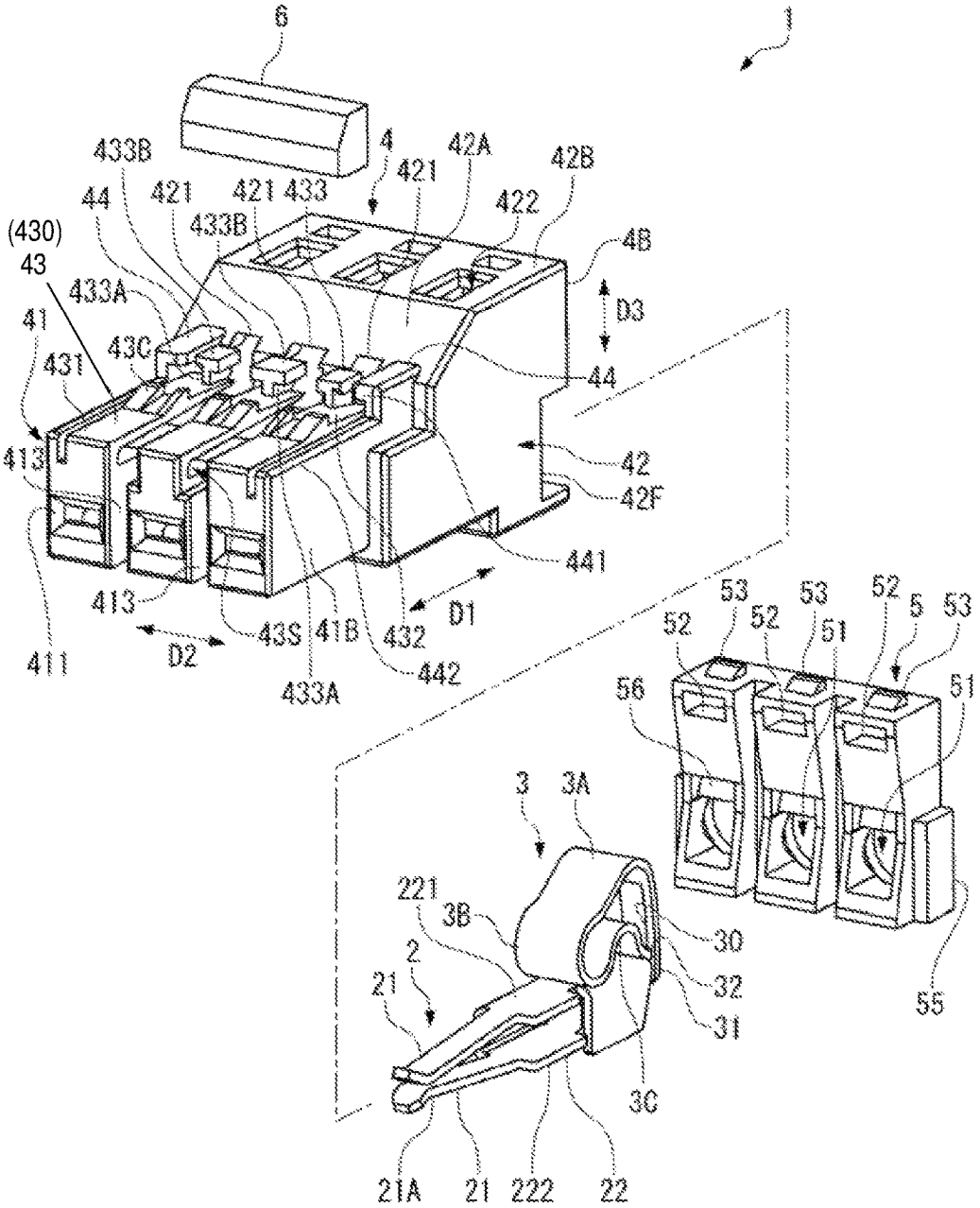
FIG. 2 is an exploded perspective view of the electrical connector of FIG. 1A.

A terminal block connector 1 according to an embodiment is shown in FIGS. 1A and 2. The terminal block connector 1 retains inside a housing 4 a plurality of female contacts 2 and a plurality of electric wire connection springs 3 for connecting electric wires 7 to those contacts 2. The terminal block connector 1 can connect one electric wire 7 directly to each contact 2 without using a crimp terminal or the like.

Figure 3B:
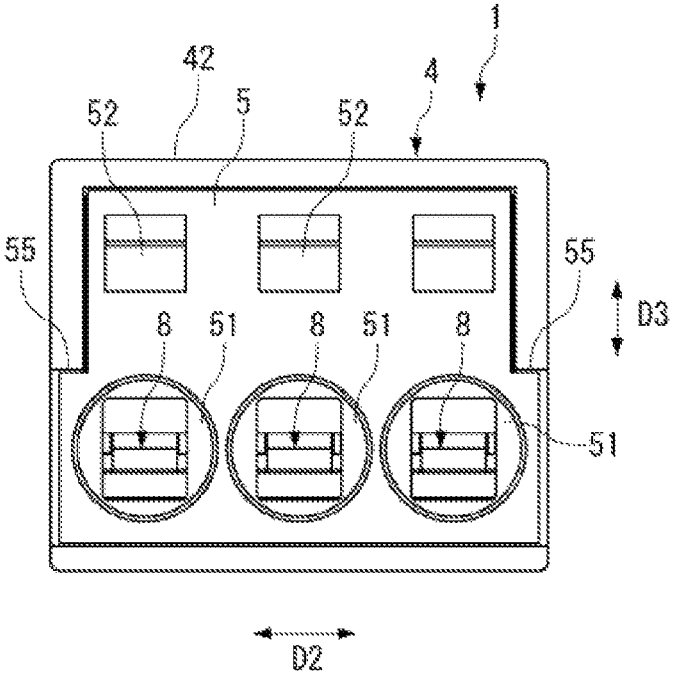
FIG. 3B is a rear view of the electrical connector of FIG. 1A.
Figure 4:
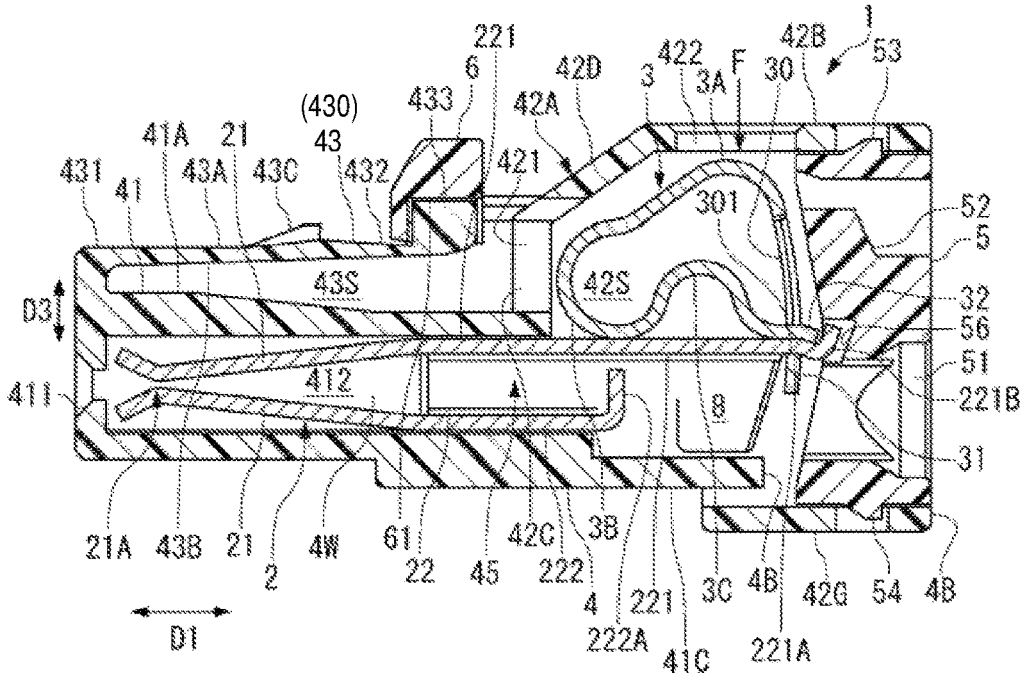
FIG. 4 is a sectional side view of the electrical connector taken along line Iv-Iv of FIG. 3A.

In the shown embodiment, the terminal block connector 1 is a multi-position connector. The terminal block connector 1 has a same number of slots 8, as shown in FIGS. 3B and 4, into which an end 7A of each electric wire 7 is inserted as the number of positions of the connector 1. The electric wire 7 is led out from the rear of the terminal block connector 1 through the slot 8. In FIG. 2, only one set of the contact 2 and the electric wire connection spring 3 is shown. The terminal block connector 1 however, has the same number of sets, three in the shown embodiment, of the contact 2 and the electric wire connection spring 3 as the number of positions.

The terminal block connector 1 is installed, for example, in a terminal device with which a machining tool or the like is provided. Such a terminal device is typically provided with multiple terminal block connectors 1. The multiple terminal block connectors 1 are so densely positioned that side faces adjoin each other.

A mating connector is mated with the terminal block connector 1 from a front of the terminal block connector 1 shown in FIG. 1A. A direction of plugging of the terminal block connector 1 with respect to the mating connector is defined as frontward/rearward direction D1 of the terminal block connector 1. In the frontward/rearward direction D1, a side of the terminal block connector 1 to be mated with the mating connector is defined as the front, and the opposite side is defined as the rear. A direction in which the plurality of contacts 2 are arranged side by side in a direction perpendicular to the frontward/rearward direction D1 is defined as widthwise direction D2 of the terminal block connector 1.

The terminal block connector 1, as shown in FIG. 2, includes the contacts 2, the electric wire connection springs 3, the housing 4 for accommodating the contacts 2 and the electric wire connection springs 3, a cover 5 attached to a rear end portion of the housing 4, and a releasing operation portion 6 for releasing the mating connector from a lock arm 43 formed in the housing 4. The slots 8 extending along the frontward/rearward direction D1 are formed frontward from electric wire insertion portions 51 of the cover 5 as shown in FIG. 4.

Figure 6A:
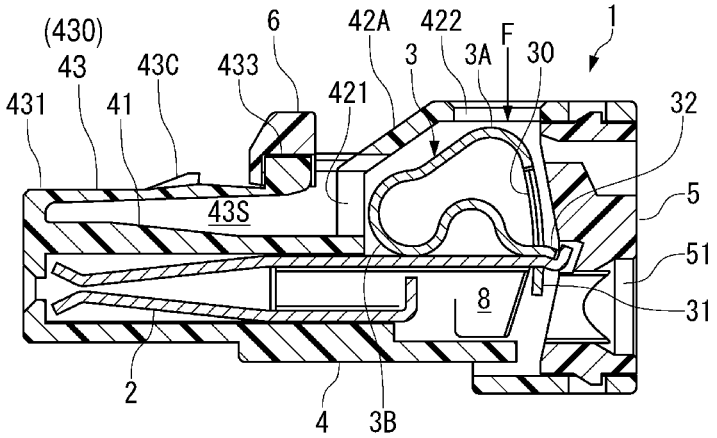
FIG. 6A is a sectional side view of the electrical connector with an electric wire connection spring in an undeformed position.
Figure 6B:
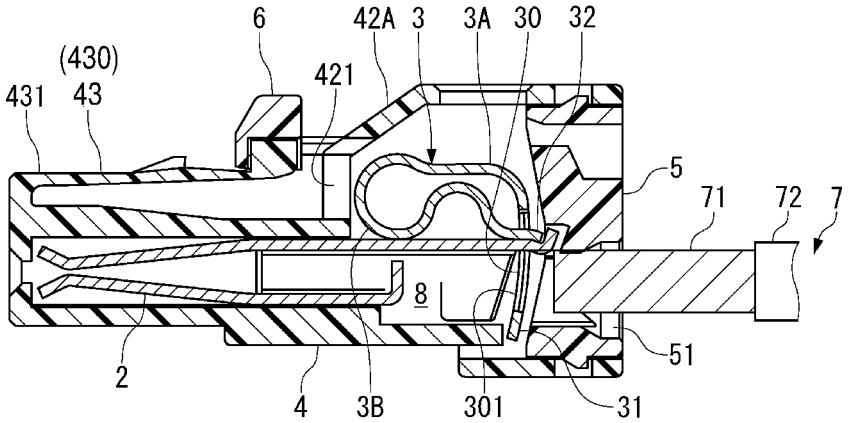
FIG. 6B is a sectional side view of the electrical connector with the electric wire connection spring in a deformed position and the electric wire before insertion into the electrical connector.

The electric wire connection spring 3 is pushed downward in a direction of arrow F from above in FIG. 4 by a tool for wire connection. The electric wire connection spring 3 thereby elastically deforms as shown in FIG. 6B. With this elastic deformation, a first end portion 31 of the electric wire connection spring 3 is displaced downward with respect to a second end portion 32 thereof. In another embodiment, the electric wire connection spring 3 may be a push-in type that does not require a tool or may be a member capable of moving in an axial direction of a screw.

Figure 1B:
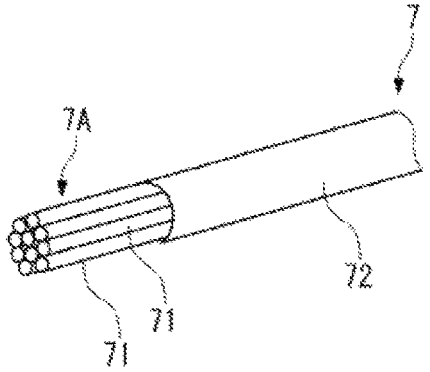
FIG. 1B is a perspective view of an electric wire.

The electric wire 7, as shown in FIG. 1B, has a core wire 71 formed from a metal material having good conductivity and a sheath 72 covering and thus insulating the core wire 7. An electric wire end 7A of the core wire 71 exposed from the sheath 72 is connected to the terminal block connector 1. The electric wire 7 shown in FIG. 1B has a plurality of core wires 71 composed of stranded wires. In another embodiment, the electric wire 7 may have a single core wire. The electric wires 7 are connected to the plurality of contacts 2 individually in the shown embodiment. However, in other embodiments, one wire 7 may be connected to a plurality of contacts 2, or a plurality of electric wires 7 may be connected to one contact 2. In an embodiment, a cylindrical member (ferrule) may be attached to the core wires 71 at the electric wire ends 7A.

Figure 6C:
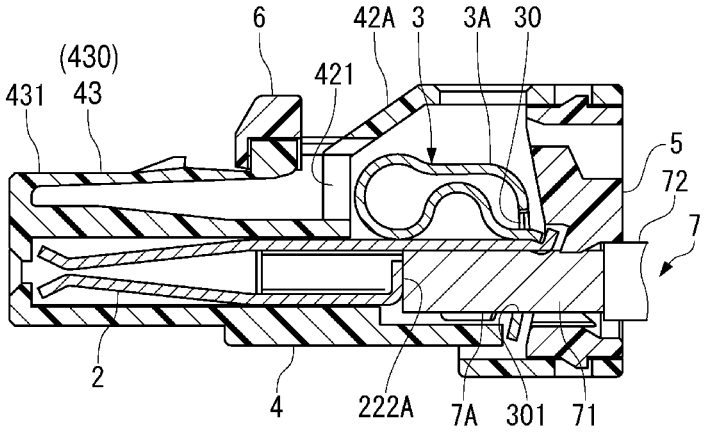
FIG. 6C is a sectional side view of the electrical wire connector with the electric wire connection spring connected to the electric wire.

The contact 2, shown in FIGS. 2 and 4, is formed by stamping and/or bending from a plate material made of a metal having elasticity and conductivity. The contact 2 has a pair of contact arms 21, 21 and a proximal end portion 22 extending into rear sides of the contact arms 21, 21. When a tabular male contact of the mating connector is inserted between the contact arms 21, 21, the contact 2 and the mating contact establish electrical continuity at a contact portion 21A. The slot 8, as shown in FIG. 4, is defined by an upper wall 221 of the proximal end portion 22 located in front of the electric wire insertion portion 51, an upright rear end portion 222A of a lower wall 222 of the proximal end portion 22, and a lower wall 41C of the housing 4. As shown in FIG. 6C, a distal end of the electric wire end 7A abuts against the rear end portion 222A, and thereby the electric wire end 7A is positioned with respect to the housing 4.

The electric wire connection spring 3, shown in FIGS. 2 and 4, exerts as elastic force to press the electric wire 7 to the contact 2 and retain the electric wire end 7A. The electric wire connection spring 3 connects the electric wire 7 to each contact 2 individually. The electric wire connection spring 3 of the present embodiment is formed by stamping and/or bending from a plate material made of a metal having elasticity and conductivity, as in the case of the contact 2.

The terminal block connector 1 has the same number of electric wire connection springs 3 as the contacts 2, and the electric wire connection springs 3 correspond to the plurality of contacts 2 individually. In other embodiments, one electric wire connection spring 3 may correspond to a plurality of contacts 2, or a plurality of electric wire connection springs 3 may correspond to one contact 2.

FIGS. 2 and 4 show the electric wire connection spring 3 in an unloaded state. The electric wire connection spring 3 is curved on the whole from the first end portion 31 to the second end portion 32.

With the elastic deformation of the electric wire connection spring 3, a window 30 formed in the electric wire connection spring 3 is displaced toward the inside of the slot 8, as shown in FIG. 6B. The window 30 constitutes a part of the slot 8 in the deformed position. The window 30 has a rectangular shape extending through the electric wire connection spring 3 in a direction of plate thickness over a predetermined range in the vicinity of the first end portion 31.

As shown in FIG. 4, between the window 30 and the second end portion 32, the electric wire connection spring 3 has a zone 3A curving frontward from a portion in which the window 30 is formed, a zone 3B located in front of and at the farthest distance from the window 30, and a zone 3C extending into the zone 3B and depressed toward an inner periphery of the electric wire connection spring 3. The zone 3B is formed in a circular-arc-like shape. The second end portion 32 is inserted into the window 30, and thereby the electric wire connection spring 3 has a closed shape. In an embodiment, the zone 3C is straight. As shown in FIG. 6B, the electric wire connection spring 3 elastically deforms from the unloaded state shown in FIG. 6A until the zone 3B takes a substantially circular shape by the zone 3A being pressed downward.

The electric wire connection spring 3, as shown in FIG. 4, is positioned on a surface of the upper wall 221 of the proximal end portion 22 of the contact 2. A rear end portion 221A of the upper wall 221 is inserted into the window 30 together with the second end portion 32. When the electric wire connection spring 3 is in the unloaded state shown in FIG. 6A, the rear end portion 221A of the contact 2 is sandwiched between a lower edge 301 of the window 30 and the second end portion 32.

When the elastic force of the electric wire connection spring 3 causes the window 30 to return upward with the electric wire end 7A passing through the window 30, as shown in FIG. 6C, an area in an opening region of the window 30 that communicates with the slot 8 is narrowed with respect to an outer diameter of the electric wire end 7A. Accordingly, the electric wire end 7A pressed upward with the lower edge 301 such that the lower edge 301 of the window 30 bites into the end 7A is connected with a predetermined contact pressure to a backside of the upper wall 221 of the contact 2 and restrained inside the window 30. In other embodiments, the electric wire connection spring 3 can be configured to have any size and shape suitable for achieving the quantity of displacement of the window 30 to allow the electric wire end 7A to pass through the window 30, as shown in FIG. 6B, and for achieving a retaining force for restraining the electric wire end 7A, as shown in FIG. 6C.

The housing 4, as shown in FIGS. 1A, 2, and 4, accommodates therein the contacts 2 and electric wire connection springs 3. The housing 4 is integrally formed in a single piece by injection molding using an insulation resin material in a mold.

The housing 4, as shown in FIGS. 1A, 2, and 4, is integrally provided with a contact accommodating portion 41 for accommodating the plurality of contacts 2, a mechanism accommodating portion 42 for accommodating the plurality of electric wire connection springs 3, an arm main body 430 of a lock arm 43 for catching the mating connector, and a protection wall 44 for protecting the lock arms 43. The lock arm 43 is positioned in front of the mechanism accommodating portion 42 on the same side in an upward/downward direction D3, a direction of thickness of the housing 4, as the mechanism accommodating portion 42 and protrudes upward with respect to the contact accommodating portion 41. The lock arm 43 is composed of the arm main body 430 integrally formed with the housing 4 and the releasing operation portion 6 separate from the housing 4.

The contact accommodating portion 41 has a substantially rectangular-parallelepiped outer shape and is configured to be mated with a housing of the mating connector. As shown in FIG. 4, the contact accommodating portion 41 forms an insertion port 411 into which a male contact of the mating connector is inserted and a cavity 412 extending from the insertion port 411 along the frontward/rearward direction D1.

The arm main body 430 supported in a cantilever-like manner at a front end portion of the contact accommodating portion 41 is positioned on an upper face side of the contact accommodating portion 41. Since a lock arm is not positioned on a lateral side in the widthwise direction D2 of the housing 4, both faces on the lateral sides in the widthwise direction D2 of the housing 4 are flat, allowing multiple terminal block connectors 1 to be arranged closely arranged side by side in the widthwise direction D2.

A plurality of arm main bodies 430 arranged side by side in the widthwise direction D2 are positioned on the upper face side of the contact accommodating portion 41 as shown in FIGS. 2 and 4. Each of the plurality of arm main bodies 430 is easily deflected and a force required for mating the terminal block connector 1 with the mating connector and unmating the terminal block 1 from the mating connector is reduced in comparison with using a single lock arm. Insertion of the connector 1 into the mating connector is therefore eased. Furthermore, since the arm main bodies 430 are distributed over almost all of the contact accommodating portion 41 in the widthwise direction D2, the mating connector can be caught stably as compared with the case that the lock arm is disposed at only one location. In another embodiment, however, the terminal block connector 1 has only a single arm main body 430.

The arm main body 430, as shown in FIGS. 2 and 4, has a fixed end 431 supported at the front end portion of the contact accommodating portion 41 and a rear end portion 432 as a free end located behind the fixed end 431. A surface 43A of the arm main body 430 has an engagement protrusion 43C for engaging with a portion of the housing of the mating connector. An air gap 43S is formed between a back face 43B of the arm main body 430 and an upper face 41A of the contact accommodating portion 41. The area of a cross section of the air gap 43S gradually increases rearward from the front thereof.

When the housing 4 is inserted into the housing of the mating connector, the arm main bodies 430 are pushed by the mating connector housing and thus deflected downward, and the engagement protrusions 43C are inserted into engagement holes of the mating connector housing. The mating connector housing is caught by the arm main bodies 430, so that the terminal block connector 1 and the mating connector are locked in a mating state. Therefore, even in the presence of an external force such as vibration or impact, the terminal block connector 1 and the mating connector remain in the mating state.

Figure 3A:
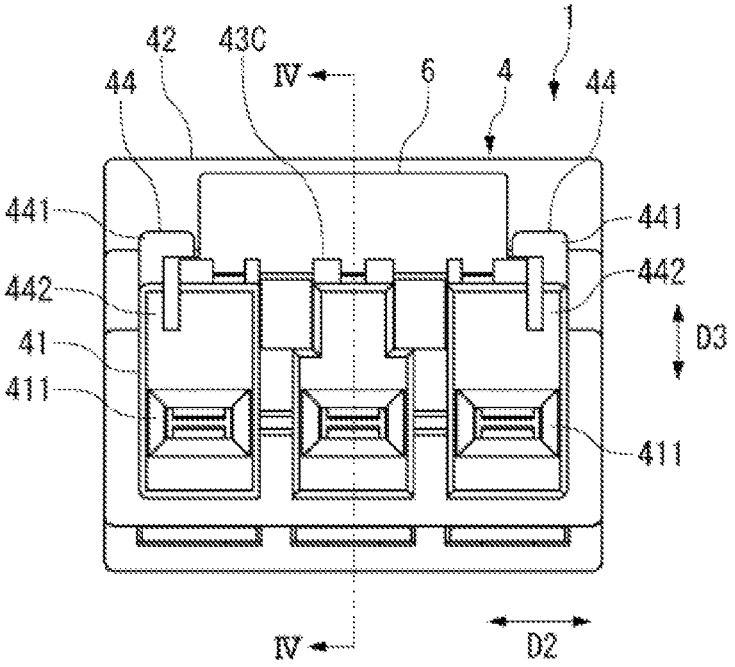
FIG. 3A is a front view of the electrical connector of FIG. 1A.

The protection wall 44 is positioned in the vicinity of the arm main body 430 as shown in FIGS. 1A and 3A. The protection wall 44 has an L-shaped portion 441 located in the vicinity of the rear end portion 432 of the arm main body 430 and a linear portion 442 extending frontward from the L-shaped portion 441. In the shown embodiment, the protection walls 44 protrude upward from both end sides in the widthwise direction D2 of the contact accommodating portion 41.

An upper end portion of each protection wall 44 in the L-shaped portion 441 protrudes inward in the widthwise direction D2 as shown in FIG. 3A. The L-shaped portion 441 is formed in an L shape as viewed from the front of the terminal block connector 1. The L-shaped portion 441 of the protection wall 44 is positioned in the vicinity of the lock arm 43 so as to prevent an excessive load from being applied to the lock arm 43 in a lateral direction during wire connection by the electric wire 7 and/or an operator's finger directly touching the lock arm 43. The L-shaped portion 441 and the linear portion 442 prevent the electric wire 7 from entering the air gap 43S on the back face side of the lock arm 43.

The arm main bodies 430 are positioned immediately above the contacts 2, respectively, inside the cavity 412 while avoiding the positions of grooves 413 shown in FIGS. 1A and 2 for accommodating inter-position walls of the mating connector housing. A releasing operation portion 6 capable of operating the arm main bodies 430 collectively is attached to the arm main bodies 430. In the shown embodiment, all three arm main bodies 430 are joined to one another with the releasing operation portion 6. When a larger number of arm main bodies 430 are provided because a larger number of positions are present, the lock arms 43 may be divided into lock arm groups each composed of a proper number of adjacent arm main bodies 430, and the releasing operation portion 6 may be given to each of the lock arm groups, in order to sufficiently deflect all of the plurality of arm main bodies 430 pushed collectively.

The rear end portion 432 of each of the three lock arm main bodies 430 has an attachment portion 433 shown in FIG. 2 to which the releasing operation portion 6 is attached. The attachment portion 433 has a vertical wall 433A protruding from a surface of the rear end portion 432 and a rectangular plate-like horizontal wall 433B supported at an upper end of the vertical wall 433A and extending perpendicular to the vertical wall 433A.

As shown in FIGS. 2 and 4, the mechanism accommodating portion 42 protrudes upward from the contact accommodating portion 41 in the vicinity of the rear end portion 432 of the arm main body 430. The mechanism accommodating portion 42 forms a mechanism front opening 421 and a tool action opening 422, in addition to an internal space 42S for accommodating the entire electric wire connection spring 3. The tool action opening 422 allows access to the electric wire connection spring 3 from outside of the mechanism accommodating portion 42. The tool action opening 422 penetrates an upper wall 42B of the mechanism accommodating portion 42 in the direction of plate thickness. The mechanism front opening 421 penetrates a front end wall 42A of the mechanism accommodating portion 42 in the plate thickness direction.

The front end wall 42A, as shown in FIGS. 2 and 4, is composed of a vertical portion 42C protruding vertically from the upper face 41A of the contact accommodating portion 41 and an inclination portion 42D extending into an upper end of the vertical portion 42C and inclined with respect to the upward/downward direction. The mechanism front opening 421 is formed in the vertical portion 42C. In other embodiments, the front end wall 42A can be configured to have any other shape provided the internal space 42S has sufficient dimensions for accommodating the electric wire connection spring 3 inside the mechanism accommodating portion 42.

The mechanism front opening 421 is located between the rear end portion 432 of the arm main body 430 and the electric wire connection spring 3 positioned in the internal space 42S in the frontward/rearward direction D1. The mechanism front opening 421 is formed in the front end wall 42A at least over a rearward projected area of the arm main body 430. The motion of a mold part for molding the back face 43B side of the arm main body 430, as described later, or a space distance and a creepage distance required for insulation between the contacts 2 is taken into consideration to define an opening region of the mechanism front opening 421.

Inside the housing 4, the same number of housing chambers 45 as the number of positions are formed over the cavity 412 and the internal space 42S described above. The housing chambers 45 are partitioned with an inter-position wall 4W as shown in FIG. 4. An assembly composed of the contact 2 and the electric wire connection spring 3 is positioned in each housing chamber 45 from an opened rear end portion 4B of the housing 4. The contact 2 is accommodated in the contact accommodating portion 41.

The cover 5, as shown in FIGS. 2 and 3B, is disposed at the rear end portion 4B of the housing 4. The cover 5 is formed from an insulating resin material. The cover 5 has the electric wire insertion portions 51, tool support portions 52 for supporting the tool for wire connection, engagement protrusions 53, 54 shown in FIG. 4 required for attaching the cover 5 to the housing 4, and locating protrusions 55.

The electric wire insertion portion 51 has an opening equivalent to an insertion port of the slot 8. The electric wire insertion portion 51 and the tool support portion 52 are formed in the cover 5 for each position of the connector 1. The tool support portion 52 supports an end portion of the tool for wire connection. When the tool for wire connection is turned frontward using the end portion as a fulcrum, an action protrusion of the tool protrudes from the tool action opening 422 into the internal space 42S and pushes the electric wire connection spring 3 downward. The cover 5 has a depression 56 for receiving an upward-bent end edge 221B of the rear end portion 221A of the contact 2 as shown in FIG. 4.

The cover 5 is attached to the housing 4 by inserting the cover 5 between the upper wall 42B and a lower wall 42G of the mechanism accommodating portion 42 while locating the cover 5 in the housing 4 by inserting the locating protrusion 55 into a recess 42F of the mechanism accommodating portion 42 as shown in FIGS. 2 and 4. At this time, the engagement protrusion 53 is inserted into an engagement hole of the upper wall 42B and the engagement protrusion 54 is inserted into an engagement hole of the lower wall 42G.

Figure 5:
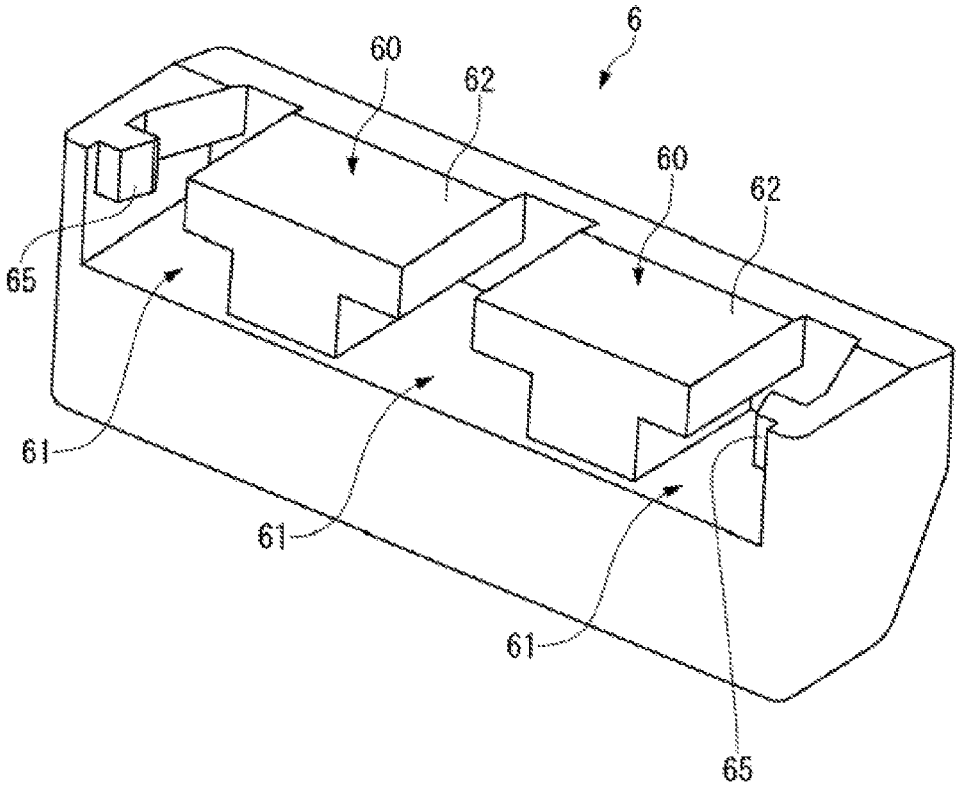
FIG. 5 is a perspective view of a releasing operation knob of the electrical connector.

The releasing operation portion 6, shown in FIGS. 1A and 5, is attached to the rear end portions 432 of the arm main body 430 integrally formed with the housing 4. By the attachment of the releasing operation portion 6, the rear end portions 432 of the lock arms 43 become easier to simultaneously push; it is possible to easily push down the releasing operation portion 6 to deflect the arm main bodies 430 until the engagement protrusions 43C are disengaged from the engagement holes of the mating connector housing in order to release locking of the mating connector. A front side and an upper side of the releasing operation portion 6 is chamfered and is therefore easy to push.

The releasing operation portion 6 is detachably attached to the rear end portion 432 of the arm main body 430. A plurality of releasing operation portions 6 may be produced with different sizes, such as different heights. The releasing operation portions 6 are thus interchangeable; a portion 6 with a large size could be used to improve an operation or a portion 6 having a low height could be used according to a height limitation of a device in which the terminal block connection 1 is disposed. Since the releasing operation portion 6 is separate from the arm main bodies 430, the releasing operation portion 6 can also be formed from a metal material.

As shown in FIG. 5, engagement protrusions 60 and engagement portions 65 for engaging with the attachment portion 433 of the arm main body 430 shown in FIG. 2 are formed on a bottom side and a rear side of the releasing operation portion 6. The plurality of engagement protrusions 60 protrude from a bottom side of the releasing operation portion 6. Recesses 61 for receiving the horizontal walls 433B of the attachment portions 433 are disposed between two engagement protrusions 60, 60 and outside the engagement protrusions 60, 60. The engagement portion 65 engages with the attachment portion 433, thereby preventing the releasing operation portion 6 from disengaging from the attachment portion 433.

By positioning the releasing operation portion 6 in front of the attachment portions 433, and sliding the releasing operation portion 6 rearward while supporting the back faces 43B of the arm main bodies 430 with a jig, the attachment portions 433 and the engagement protrusions 60 engage with each other, and the engagement portions 65 engage with the vertical walls 433A of the attachment portions 433 located at both end sides in the widthwise direction D2. In this manner, the releasing operation portion 6 is connected to the arm main bodies 430.

When the releasing operation portion 6 is assembled with the arm main bodies 430, the engagement portions 65 on both sides restricts frontward disengagement of the releasing operation portion 6. In addition, the engagement protrusion 60 and the attachment portion 433 having a shape substantially similar to the engagement protrusion 60 are engaged so as to fill a gap between the releasing operation portion 6 and the arm main body 430, so that a movement of the releasing operation portion 6 in the upward/downward direction D3 and in the widthwise direction D2 is restricted. Therefore, the releasing operation portion 6 can be stably depressed.

The use of the terminal block connector 1 will be now be described in greater detail.

The contacts 2 and/or the core wire 71 generates heat with electrical resistance at a location of contact between the contact 2 and the core wire 71 of the electric wire end 7A, the contact portion 21A of the contact 2, or the like. Since the second end portion 32 is in contact with the contact 2 and the lower edge 301 of the window 30 is in contact with the core wire 71 immediately near the location of contact between the contact 2 and the core wire 71 coming into contact with each other, heat is easily transmitted from the contact 2 and/or the core wire 71 to the electric wire connection spring 3. Through the mechanism front opening 421 located in the vicinity of the electric wire connection spring 3, the heat of the electric wire connection spring transmitted from the contact 2 and/or the core wire 71 can be sufficiently released into external air through the mechanism front opening 421. Therefore, it is possible to allow large currents to flow while avoiding overheating of the electric wire 7 and/or the housing 4.

The housing 4 and the cover 5 have a plurality of openings, including the tool action openings 422 and holes opened in the tool support portions 52 of the cover 5, in addition to the mechanism front openings 421. Therefore, air entering the housing chamber 45 through some of these openings exits through another opening, and the housing chamber 45 is thus ventilated. It is therefore possible to avoid heat accumulation inside the housing chamber 45.

The mechanism front opening 421 is located between the rear end portion 432 of the arm main body 430 and the electric wire connection spring 3 positioned in the internal space 42S in the frontward/rearward direction D1. Therefore, a route from the internal space 42S to the air gap 43S through the mechanism front opening 421 extends along the frontward/rearward direction D1. The rearward projected area of the arm main body 430, including the attachment portion 433, is within the opening region of the mechanism front opening 421. Accordingly, a mold part for molding a portion from the back face 43B side of the arm main body 430 to the bottom side and rear side of the attachment portion 433 can pass through the mechanism front opening 421. The mold part can therefore move along the frontward/rearward direction D1 so that it is possible to mold the back face 43B side of the arm main body 430.

Without the mechanism front opening 421, the direction of movement of the mold part for molding the back face 43B side of the arm main body 430 would need to be set in the widthwise direction D2 perpendicular to the frontward/rearward direction D1. This would make it impossible to mold the protection wall 44 which is indispensable for protection of the arm main body 430.

The protection wall 44 is molded from a mold part different from the mold part for molding the back face 43B side of the arm main body 430. A protection wall 44 having a suitable size can be positioned in the vicinity of the arm main body 430 according to usage of the terminal block connector 1 and/or the degree of necessity of damage prevention.

The mechanism front opening 421 also makes it possible to give a lock function to the terminal block connector 1 while avoiding an increase in the thickness of the housing 4. Because the mechanism front opening 421 is formed in the front end wall 42A of the mechanism accommodating portion 42, the arm main bodies 430 integral with the housing 4 do not interfere with a mold part for molding a peripheral portion thereof. The arm main body 430 and the protection wall 44 can be integrally molded with the housing 4 on the same side as the mechanism accommodating portion 42 in the thickness direction of the housing 4 and in a space in front of the mechanism accommodating portion 42. It is therefore possible to avoid an increase in the thickness of the terminal block connector 1 even with the mechanism accommodating portion 42 protruding. Since the releasing operation portion 6 of the lock arm 43 is formed separately from the housing 4, the housing 4 can be provided with the lock arm 43 having the releasing operation portion 6 without a limitation about housing molding.

The mechanism front opening 421 thus makes it possible to provide the terminal block connector 1 with the lock function while avoiding an increase in the thickness of the housing 4, and can also contribute to heat release. Even when the height of the lock arm 43 is limited by the opening area of the mechanism front opening 421, such a limitation can be overcome by attachment of the releasing operation portion 6.

What is claimed is:

1. An electrical connector, comprising:

a contact;

a housing retaining the contact; and a plurality of lock arms configured to catch a mating connector, each of the lock arms having an arm main body and an attachment portion each having a vertical and a horizontal wall integrally formed with the housing and a releasing operation portion, the releasing operation portion has a plurality of recesses for receiving the horizontal walls of the attachment portions, formed separately from the housing and attached to the arm main body.

2. The electrical connector of claim 1, wherein the releasing operation portion is configured to be pushed to deflect the arm main body and release the mating connector from each of the lock arms.

3. The electrical connector of claim 1, wherein at least two of the arm main bodies adjacent to each other are joined by the releasing operation portion.

4. The electrical connector of claim 3, wherein each recess receives the attachment portion of one of the arm main bodies.

5. The electrical connector of claim 4, wherein the releasing operation portion has an engagement portion configured to restrict disengagement of the attachment portion from the recess.

6. The electrical connector of claim 5, wherein each recess of the releasing operation portion receives the attachment portion in a first direction perpendicular to a second direction in which the arm main bodies are adjacent to each other.

7. The electrical connector of claim 1, wherein the housing is integrally formed with a contact accommodating portion receiving the contact and a mechanism accommodating portion.

8. The electrical connector of claim 7, wherein the mechanism accommodating portion receives an electric wire connection mechanism connecting an electric wire to the contact.

9. The electrical connector of claim 8, wherein the arm main body is supported on the contact accommodating portion in front of the mechanism accommodating portion.

10. The electrical connector of claim 9, wherein the mechanism accommodating portion has an opening disposed between a rear end portion of the arm main body and the electric wire connection mechanism.

11. The electrical connector of claim 10, wherein the housing has a protection wall disposed in a vicinity of each of the lock arms.

12. The electrical connector of claim 11, wherein the protection wall is formed integrally with the arm main body in a single piece.

* * * * *